US007730972B2

(12) United States Patent
Hall et al.

(10) Patent No.: US 7,730,972 B2
(45) Date of Patent: Jun. 8, 2010

(54) DOWNHOLE TURBINE

(75) Inventors: David R. Hall, Provo, UT (US); Scott Dahlgren, Alpine, UT (US); Jonathan Marshall, Provo, UT (US)

(73) Assignee: Schlumberger Technology Corporation, Houston, TX (US)

( * ) Notice: Subject to any disclaimer, the term of this patent is extended or adjusted under 35 U.S.C. 154(b) by 0 days.

(21) Appl. No.: 12/262,372

(22) Filed: Oct. 31, 2008

(65) Prior Publication Data

US 2009/0050372 A1 Feb. 26, 2009

Related U.S. Application Data

(63) Continuation-in-part of application No. 12/178,467, filed on Jul. 23, 2008, which is a continuation-in-part of application No. 12/039,608, filed on Feb. 28, 2008, which is a continuation-in-part of application No. 12/037,682, filed on Feb. 26, 2008, now Pat. No. 7,624,824, which is a continuation-in-part of application No. 12/019,782, filed on Jan. 25, 2008, now Pat. No. 7,617,886, which is a continuation-in-part of application No. 11/837,321, filed on Aug. 10, 2007, now Pat. No. 7,559,379, which is a continuation-in-part of application No. 11/750,700, filed on May 18, 2007, now Pat. No. 7,549,489, which is a continuation-in-part of application No. 11/737,034, filed on Apr. 18, 2007, now Pat. No. 7,503,405, which is a continuation-in-part of application No. 11/686,638, filed on Mar. 15, 2007, now Pat. No. 7,424,922, which is a continuation-in-part of application No. 11/680,997, filed on Mar. 1, 2007, now Pat. No. 7,419,016, which is a continuation-in-part of application No. 11/673,872, filed on Feb. 12, 2007, now Pat. No. 7,484,576, which is a continuation-in-part of application No. 11/611,310, filed on Dec. 15, 2006, now Pat. No. 7,600,586, application No. 12/262,372, which is a continuation-in-part of application No. 11/278,935, filed on Apr. 6, 2006, now Pat. No. 7,426,968, which is a continuation-in-part of application No. 11/277,394, filed on Mar. 24, 2006, now Pat. No. 7,398,837, which is a continuation-in-part of application No. 11/277,380, filed on Mar. 24, 2006, now Pat. No. 7,337,858, which is a continuation-in-part of application No. 11/306,976, filed on Jan. 18, 2006, now Pat. No. 7,360,610, which is a continuation-in-part of application No. 11/306,307, filed on Dec. 22, 2005, now Pat. No. 7,225,886, which is a continuation-in-part of application No. 11/306,022, filed on Dec. 14, 2005, now Pat. No. 7,198,119, which is a continuation-in-part of application No. 11/164,391, filed on Nov. 21, 2005, now Pat. No. 7,270,196, application No. 12/262,372, which is a continuation-in-part of application No. 11/555,334, filed on Nov. 1, 2006, now Pat. No. 7,419,018.

(51) Int. Cl.
*E21B 7/06* (2006.01)
*E21B 10/26* (2006.01)

(52) U.S. Cl. ..... 175/61; 175/73; 175/107; 175/385; 175/399

(58) Field of Classification Search ..... 175/61, 175/73, 106, 107, 385, 399
See application file for complete search history.

(56) References Cited

U.S. PATENT DOCUMENTS

| | | | | |
|---|---|---|---|---|
| 4,637,479 | A * | 1/1987 | Leising | 175/26 |
| 5,314,030 | A * | 5/1994 | Peterson et al. | 175/26 |
| 5,553,678 | A * | 9/1996 | Barr et al. | 175/73 |
| 6,089,332 | A * | 7/2000 | Barr et al. | 175/45 |
| 2004/0238221 | A1 * | 12/2004 | Runia et al. | 175/61 |

* cited by examiner

*Primary Examiner*—Hoang Dang
(74) *Attorney, Agent, or Firm*—Holme Roberts & Owen LLP

(57) ABSTRACT

In one aspect of the present invention, a drill bit has a jack element that is substantially coaxial with an axis of rotation of the drill bit and the jack element has an asymmetrical distal end that extends beyond a working face of the drill bit. A turbine is located within a bore formed in the drill bit and a flow valve is actuated by the turbine. The flow valve is adapted to route a drilling fluid in the bore into a porting mechanism adapted to extend the jack element farther beyond the working surface of the drill bit. The turbine is also adapted to rotate the jack element at variable speeds.

18 Claims, 12 Drawing Sheets

DOWNHOLE TURBINE

CROSS REFERENCE TO RELATED APPLICATIONS

This Patent Application is a continuation-in-part of U.S. patent application Ser. No. 12/178,467 Jul. 23, 2008 which is a continuation-in-part of U.S. patent application Ser. No. 12/039,608 Feb. 28, 2008 which is a continuation-in-part of U.S. patent application Ser. No. 12/037,682 Feb. 26, 2008 now U.S. Pat. No. 7,624,824, which is a is a continuation-in-part of U.S. patent application Ser. No. 12/019,782 Jan. 25, 2008 now U.S. Pat. No. 7,617,886, which is a continuation-in-part of U.S. patent application Ser. No. 11/837,321 Aug. 10, 2007 now U.S. Pat. No. 7,559,379, which is a continuation-in-part of U.S. patent application Ser. No. 11/750,700, May 18, 2007 now U.S. Pat. No. 7,549,489. U.S. patent application Ser. No. 11/750,700 is a continuation-in-part of U.S. patent application Ser. No. 11/737,034, Apr. 18, 2007 now U.S. Pat. No. 7,503,405. U.S. patent application Ser. No. 11/737,034 is a continuation-in-part of U.S. patent application Ser. No. 11/686,638 Mar. 15, 2007, now U.S. Pat. No. 7,424,922. U.S. patent application Ser. No. 11/686,638 is a continuation-in-part of U.S. patent application Ser. No. 11/680,997 Mar. 1, 2007, now U.S. Pat. No. 7,419,016. U.S. patent application Ser. No. 11/680,997 is a continuation in-part of U.S. patent application Ser. No. 11/673,872, Feb. 12, 2007 now U.S. Pat. No. 7,484,576. U.S. patent application Ser. No. 11/673,872 is a continuation in-part of U.S. patent application Ser. No. 11/611,310 Dec. 15, 2006 now U.S. Pat. No. 7,600,586. This Patent Application is also a continuation-in-part of U.S. patent application Ser. No. 11/278,935 Apr. 6, 2006 now U.S. Pat. No. 7,426,968. U.S. patent application Ser. No. 11/278,935 is a continuation-in-part of U.S. patent application Ser. No. 11/277,294 Mar. 24, 2006 now U.S. Pat. No. 7,398,837. U.S. patent application Ser. No. 11/277,394 is a continuation in-part of U.S. patent application Ser. No. 11/277,380 Mar. 24, 2006 now U.S. Pat. No. 7,337,858. U.S. patent application Ser. No. 11/277,380 is a continuation-in-part of U.S. patent application Ser. No. 11/306,976 Jan. 18, 2006 now U.S. Pat. No. 7,360,610. U.S. patent application Ser. No. 11/306,976 is a continuation-in-part of 11/306,307 Dec. 22, 2005 now U.S. Pat. No. 7,225,886. U.S. patent application Ser. No. 11/306,307 is a continuation in-part of U.S. patent application Ser. No. 11/306,022 Dec. 14, 2005 now U.S. Pat. No. 7,198,119. U.S. patent application Ser. No. 11/306,022 is a continuation-in-part of U.S. patent application Ser. No. 11/164,391 Nov. 21,2005 now U.S. Pat. No. 7,270,196. This application is also a continuation in-part of U.S. patent application Ser. No. 11/555,334 now U.S. Pat. No. 7,419,018, which was filed on Nov. 1, 2006. All of these applications are herein incorporated by reference in their entirety.

BACKGROUND OF THE INVENTION

This invention relates to the field of percussive tools used in drilling. More specifically, the invention includes a downhole jack hammer which may be actuated by drilling fluid.

The prior art has addressed the operation of a downhole hammer actuated by drilling mud. Such operations have been addressed in the U.S. Pat. No. 7,073,610 to Susman, which is herein incorporated by reference for all that it contains. The '610 patent discloses a downhole tool for generating a longitudinal mechanical load. In one embodiment, a downhole hammer is disclosed which is activated by applying a load on the hammer and supplying pressurizing fluid to the hammer.

The hammer includes a shuttle valve and piston that are moveable between first and farther position, seal faces of the shuttle valve and piston being released when the valve and the piston are in their respective farther positions, to allow fluid flow through the tool. When the seal is releasing, the piston impacts a remainder of the tool to generate mechanical load. The mechanical load is cyclical by repeated movements of the shuttle valve and piston.

U.S. Pat. No. 6,994,175 to Egerstrom, which is herein incorporated by reference for all that it contains, discloses a hydraulic drill string device that can be in the form of a percussive hydraulic in-hole drilling machine that has a piston hammer with an axial through hole into which a tube extends. The tube forms a channel for flushing fluid from a spool valve and the tube wall contains channels with ports cooperating with the piston hammer for controlling the valve.

U.S. Pat. No. 4,819,745 to Walter, which is herein incorporated by reference for all that it contains, discloses a device placed in a drill string to provide a pulsating flow of the pressurized drilling fluid to the jets of the drill bit to enhance chip removal and provide a vibrating action in the drill bit itself thereby to provide a more efficient and effective drilling operation.

BRIEF SUMMARY OF THE INVENTION

In one aspect of the present invention, a drill bit has a jack element that is substantially coaxial with an axis of rotation of the drill bit and the jack element has an asymmetrical distal end that extends beyond a working face of the drill bit. A turbine is located within a bore formed in the drill bit and a flow valve is actuated by the turbine. The flow valve is adapted to route a drilling fluid in the bore into a porting mechanism adapted to extend the jack element farther beyond the working surface of the drill bit. The turbine is also adapted to rotate the jack element at variable speeds.

A first gear box disposed intermediate the turbine and the jack element may be adapted to transfer torque from a drive shaft of the turbine to the jack element. A second gear box disposed intermediate the turbine and the porting mechanism may be adapted to transfer torque from a drive shaft of the turbine to the flow valve.

A flow guide may be disposed intermediate a plurality of blades of the turbine and a wall of the bore and may be adapted to guide the flow of drilling fluid across the turbine. A first end of the flow guide may have a diameter larger than a diameter of a second end of the flow guide. The flow guide may have a tapered interior surface. An actuator disposed within the bore may be adapted to move the flow guide along a central axis of the drill bit towards and away from a bottom end of the turbine. The actuator may be a solenoid valve, an aspirator, a hydraulic piston, a pump, a dc motor, an ac motor, a rack and pinion, or combinations thereof.

The turbine may actuate an electrical generator disposed proximate the drill bit. The turbine may rotate the jack element in a direction opposite to a direction of rotation of the drill bit. Sensors disposed proximate magnets connected to the jack element may be adapted to detect the orientation of the jack element and a rotational speed of the jack element. The porting mechanism may be adapted to oscillate the jack element extending the jack element farther beyond the working surface of the drill bit and back again. The jack element may have a bearing, a bushing, or a combination thereof. The porting mechanism may have a piston adapted to extend the jack element beyond the working surface of the drill bit. The flow valve may be adapted to route the drilling fluid in the porting mechanism out of the porting mechanism and toward a formation. The turbine may be disposed in a component of a drill string in communication with the drill bit. The drill bit may be in communication with a telemetry network.

A method for steering a drill bit through a formation may use the steps of providing a jack element substantially coaxial with an axis of rotation of the drill bit, the jack element comprises an asymmetrical distal end extending beyond a working face of the drill bit, a turbine located within a bore formed in the drill bit and adapted to rotate the jack element at variable speeds, a porting mechanism adapted to extend the jack element farther beyond the working surface of the drill bit, and a flow valve actuated by the turbine; directing a drilling fluid flow across the turbine; actuating a flow valve such that the drilling fluid is directed into the porting mechanism; extending the jack element and the asymmetrical tip of the jack element farther beyond the working surface of the drill bit; and rotating the asymmetrical tip of the jack element to a desired orientation.

In another aspect of the invention, a pipe segment comprises a turbine located within a bore of a the pipe segment and a mechanism is disposed within the bore that is adapted to change the rotational speed of the turbine. The pipe segment may be a component of a drill string, tool string, production string, pipeline, drill bit, or combinations thereof. The change in rotational speed may be detected anywhere within the bore of the drill string, tool string, production string, and/or pipeline due to a fluid pressure change within the bore. The change of fluid pressure may be used for communication along the drill string, tool string, production string, and/or pipeline.

The mechanism may be a flow guide that controls the amount of fluid that engages the turbine blades. In other embodiments, the mechanism is adapted to change an engagement angle of the turbine blades and/or stators associated with the turbine.

DETAILED DESCRIPTION OF THE INVENTION AND THE PREFERRED EMBODIMENT

Figure 1:
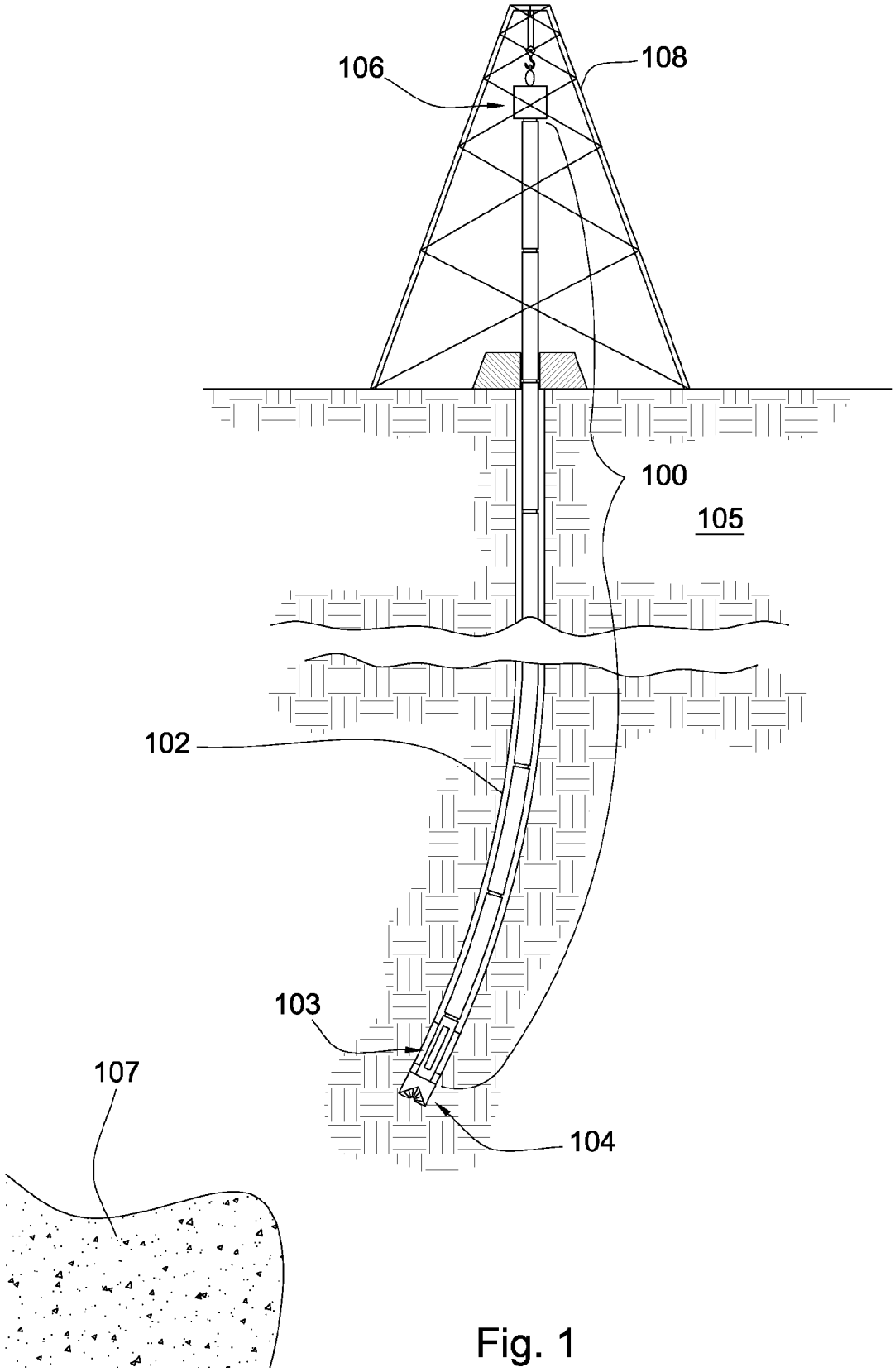
FIG. 1 is a cross-sectional diagram of an embodiment of a drill string suspended in a bore hole.

FIG. 1 is a perspective diagram of an embodiment of a drill string 100 suspended by a derrick 108 in a bore hole 102. A drilling assembly 103 is located at the bottom of the bore hole 102 and comprises a drill bit 104. As the drill bit 104 rotates downhole the drill string 100 advances farther into the earth. The drill string 100 may penetrate soft or hard subterranean formations 105. The drilling assembly 103 and/or downhole components may comprise data acquisition devices adapted to gather data. The data may be sent to the surface via a transmission system to a data swivel 160. The data swivel 106 may send the data to the surface equipment. Farther, the surface equipment may send data and/or power to downhole tools, the drill bit 104 and/or the drilling assembly 103. U.S. Pat. No. 6,670,880 which is herein incorporated by reference for all that it contains, discloses a telemetry system that may be compatible with the present invention; however, other forms of telemetry may also be compatible such as systems that include mud pulse systems, electromagnetic waves, radio waves, wired pipe, and/or short hop.

Figure 2:
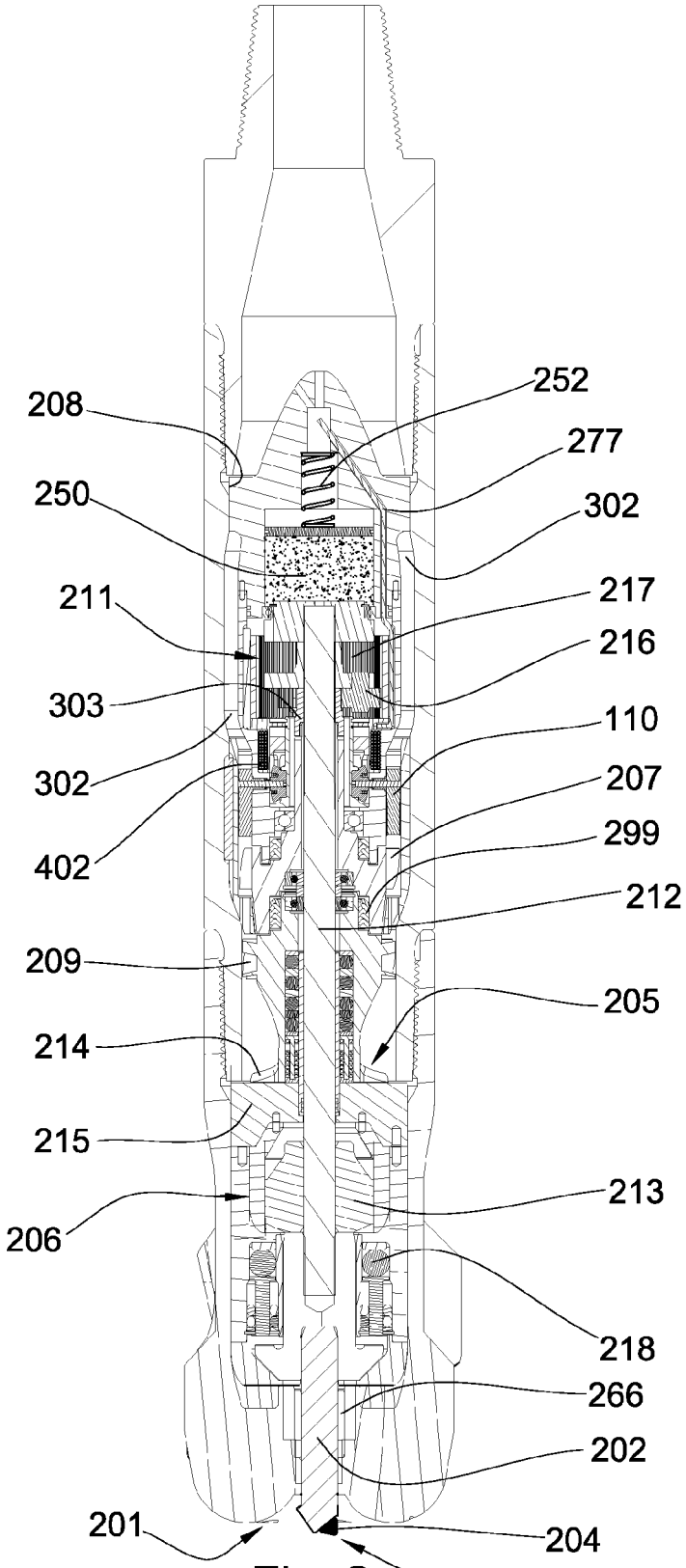
FIG. 2 is a cross-sectional diagram of an embodiment of a drill bit.

Referring now to FIG. 2, the drill bit 104 comprises a jack element 202 substantially coaxial with an axis of rotation of the drill bit 104. The jack element 202 comprises an asymmetrical distal end 203 extending beyond a working surface 201 of the drill bit 104 and the asymmetrical distal end 203 may comprise a conical diamond tip 204. U.S. patent application Ser. No. 12/051,689 to Hall, which is herein incorporated by reference for all that it contains, discloses a conical diamond tip that may be compatible with the present invention. The jack element 202 is adapted to rotate and a bushing 266 may be disposed intermediate the jack element 202 and the drill bit 104 and may be adapted to reduce frictional wear on the jack element 202.

A turbine 207 is located within a bore 208 formed in the drill bit 104 and is adapted to rotate the jack element 202. A first gear box 211 may be disposed in the bore 208 and may be adapted to transfer torque from a drive shaft 303 of the turbine 207 to the jack element 202. The first gear box 211 may transfer torque to the jack element 202 via a drive rod 212. The drive rod 212 of the first gear box 211 may extend through an entire length of the drive shaft 303 of the turbine 207 and along a central axis of the drive shaft 303 of the turbine 207. The first gear box 211 may comprise a set of planetary gears 216 adapted to transfer torque from the drive shaft 303 of the turbine 207 to the drive rod 212 of the first gear box 211 and may reduce the magnitude of the torque transferred from the drive shaft 303 to the drive rod 212. The set of planetary gears 216 may transfer a quarter of the torque from the drive shaft 303 to the drive rod 212. The first gear box 211 may comprise a second set of planetary gears 217 adapted to reduce the magnitude of the torque transferred from the set of planetary gears 216 to the drive rod 212 of the first gear box 211. The second set of planetary gears 217 may transfer a quarter of the torque from the set of planetary gears 216 to the drive rod 212 of the first gear box 21 1. The turbine 207 may rotate the jack element 202 in a direction opposite to a direction of rotation of the drill bit 104. It is believed that by adapting the turbine 207 to rotate the jack element 202 in a direction opposite to a direction of rotation of the drill bit 104 the asymmetrical distal end 203 of the jack element 202 will remain rotationally stationary with regards to the formation 105 and may direct the drill bit 104 and drill string 100 in a preferred direction through the formation 105.

The drill bit 104 may also comprise a flow valve 205 adapted to route a drilling fluid 405 in the bore 208 into a porting mechanism 206 disposed in the drill bit 104. The flow valve 205 may comprise a first disc 214 and second 215 disc that may be substantially contacting along a substantially flat interface substantially normal to an axis of rotation. The first disc 214 may comprise blades 209 which may be adapted to rotate the first disc 214 with respect to the second disc 111 as drilling fluid 405 flows across the blades 209. The first disc 214 may comprise a first set of ports adapted to align and misalign with a second set of ports of the second disc 215. The porting mechanism 206 is adapted to extend the jack element 202 farther beyond the working surface 201 of the drill bit 104. The porting mechanism 206 may comprise a piston 213 adapted to extend the jack element 202 farther beyond the working surface 201 of the drill bit 104. The porting mechanism 206 may be adapted to oscillate the jack element 202 extending the jack element 202 farther beyond the working surface 201 of the drill bit 104 and back again. The flow valve 205 may direct the drilling fluid 405 into the porting mechanism 206 and beneath the piston 213 intermediate the piston 213 and the jack element 202 thereby lifting the piston 213 towards the turbine 207. The flow valve 205 may be adapted to route the drilling fluid 405 in the porting mechanism 206 out of the porting mechanism 206 and toward the formation 105 thereby allowing the piston 213 to lower towards the jack element 202 and extend the jack element 202 farther beyond the working surface 201 of the drill bit 104. It is believed that oscillating the jack element 202, extending the jack element 202 farther beyond the working surface 201 of the drill bit 104 and back again, while the working surface 201 of the drill bit 104 is adjacent to the formation 105 may allow the jack element 202 to degrade the formation 105. An embodiment of a flow valve and an embodiment of a porting mechanism that may be compatible with the present invention is disclosed in U.S. patent application Ser. No. 12/178,467 to Hall, which is herein incorporated by reference for all that it contains.

Figure 3:
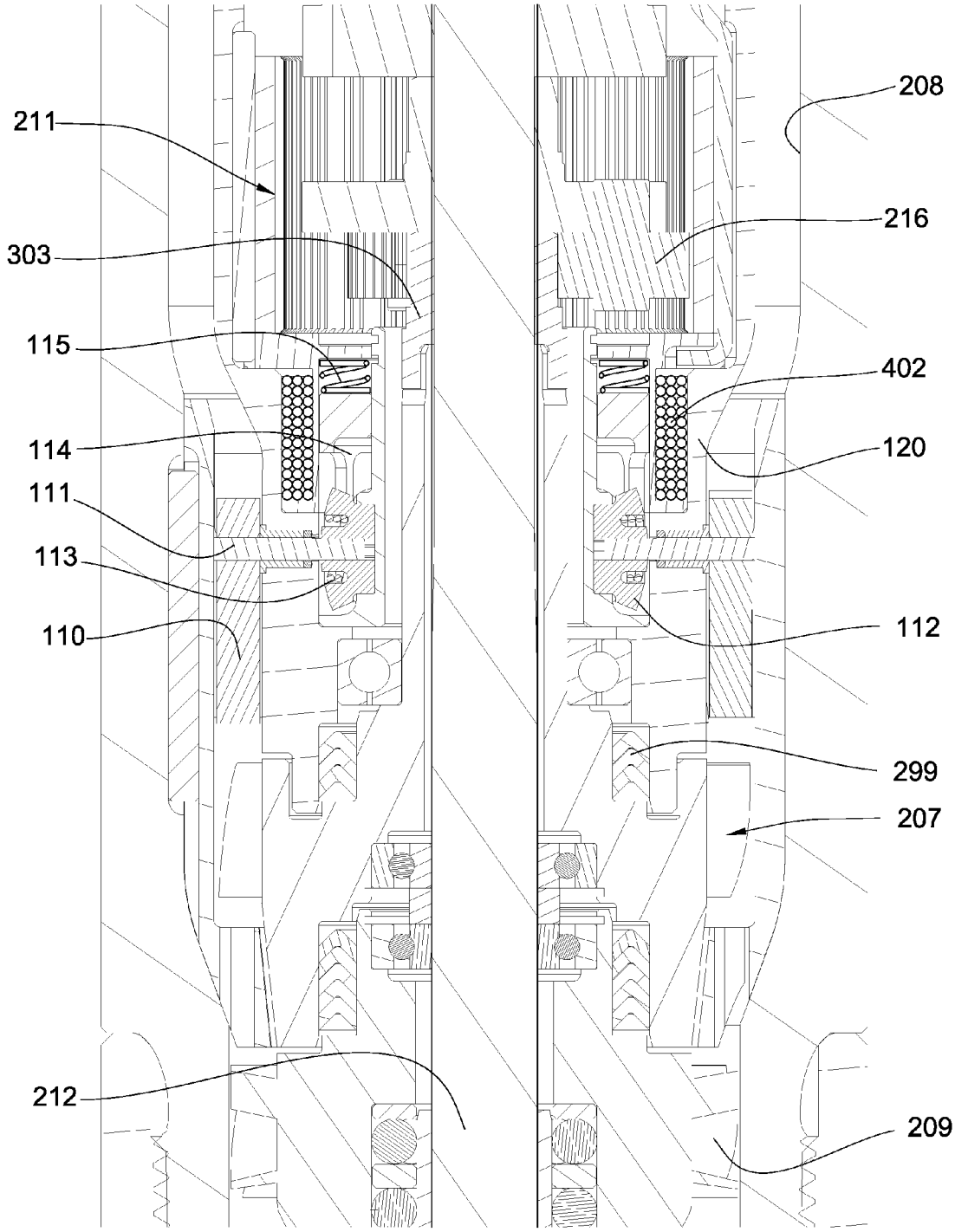
FIG. 3 is a cross-sectional diagram of an embodiment of a turbine and an adjustable stator disposed in the drill bit.
Figure 4A:
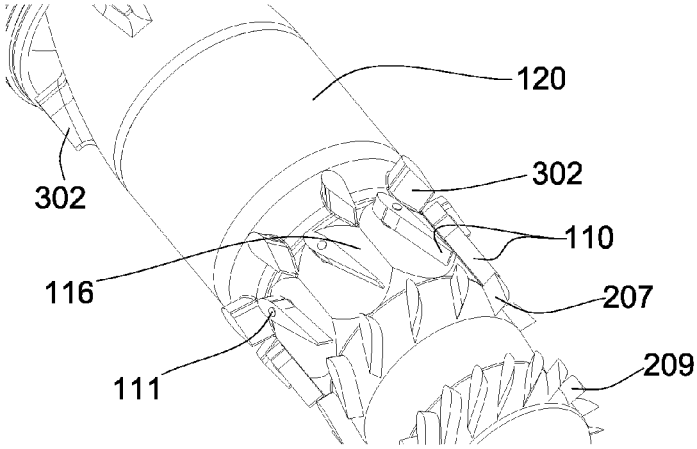
FIG. 4*a* is a prospective diagram of an embodiment of a turbine and an adjustable stator disposed in the drill bit.
Figure 4B:
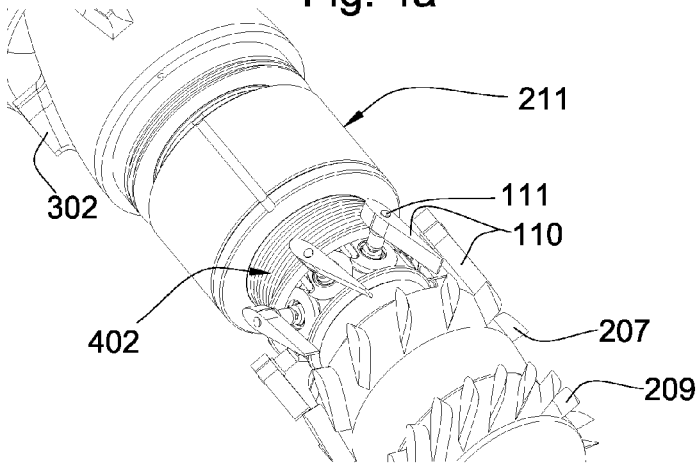
FIG. 4*b* is a prospective diagram of an embodiment of a turbine and an adjustable stator disposed in the drill bit.
Figure 4C:
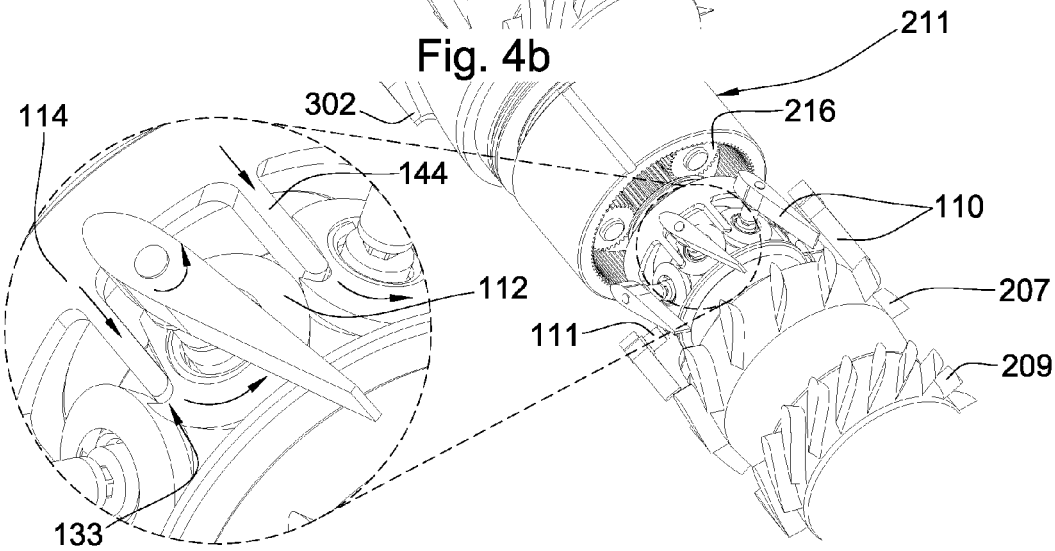
FIG. 4*c* is a prospective diagram of an embodiment of a turbine and an adjustable stator disposed in the drill bit.
Figure 5:
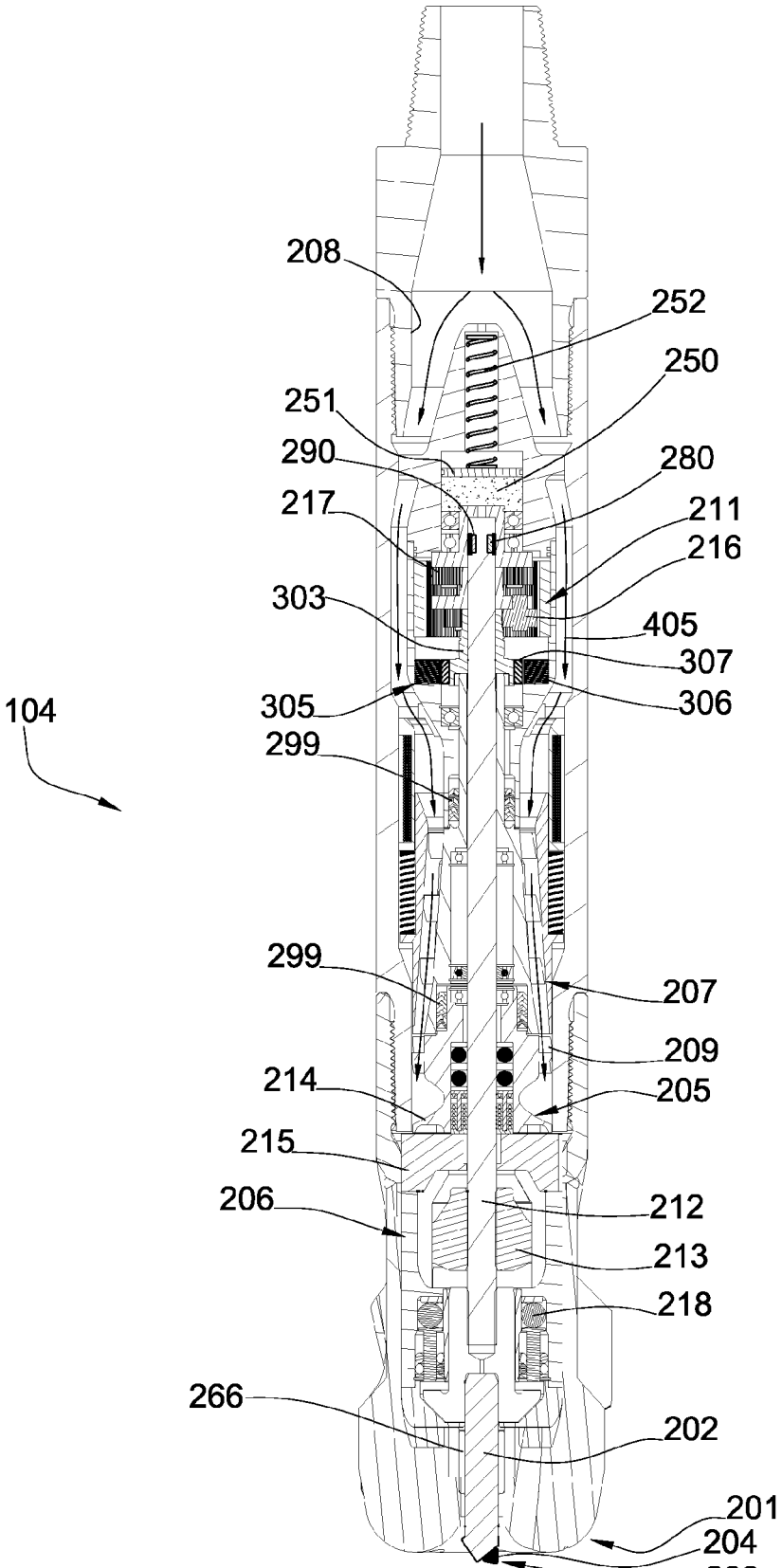
FIG. 5 is a cross-sectional diagram of another embodiment of a drill bit.
Figure 6:
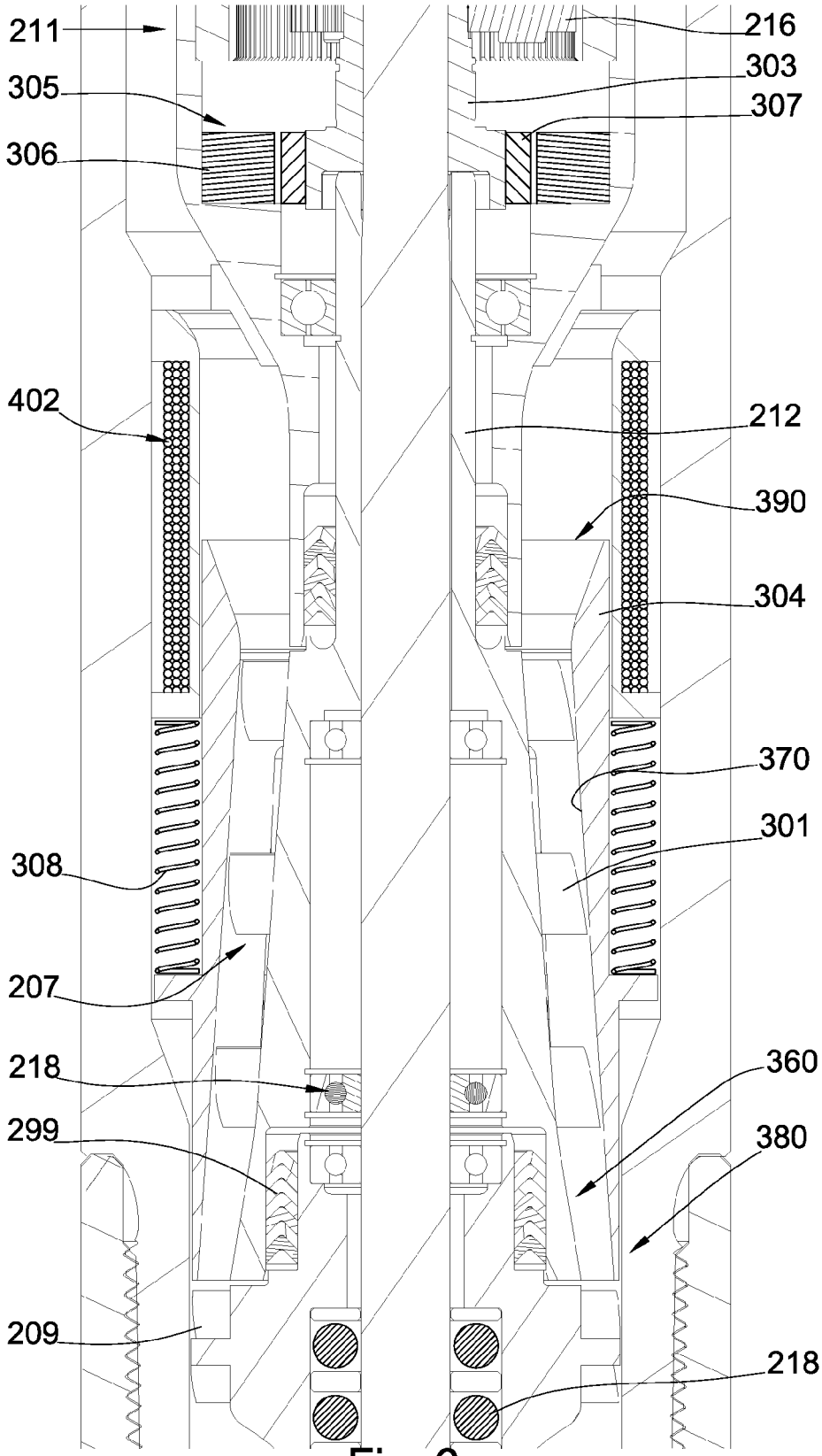
FIG. 6 is a cross-sectional diagram of an embodiment of a turbine and a flow guide disposed in the drill bit.
Figure 7A:
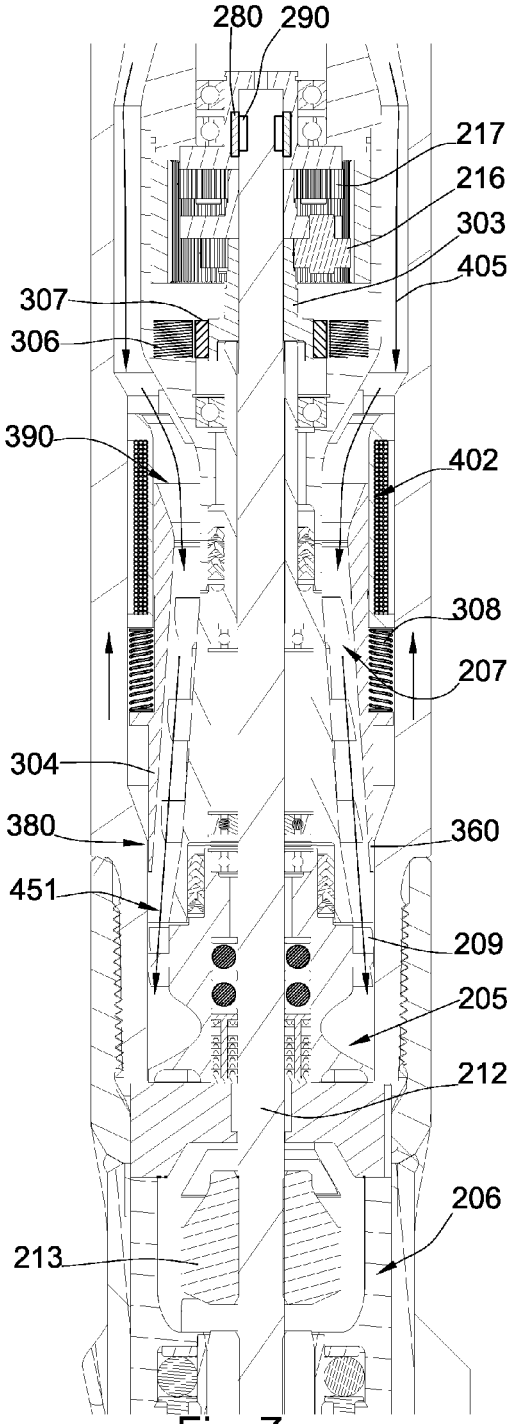
FIG. 7*a* is a cross-sectional diagram of an embodiment of a flow guide, an actuator and a turbine disposed in a drill bit.
Figure 7B:
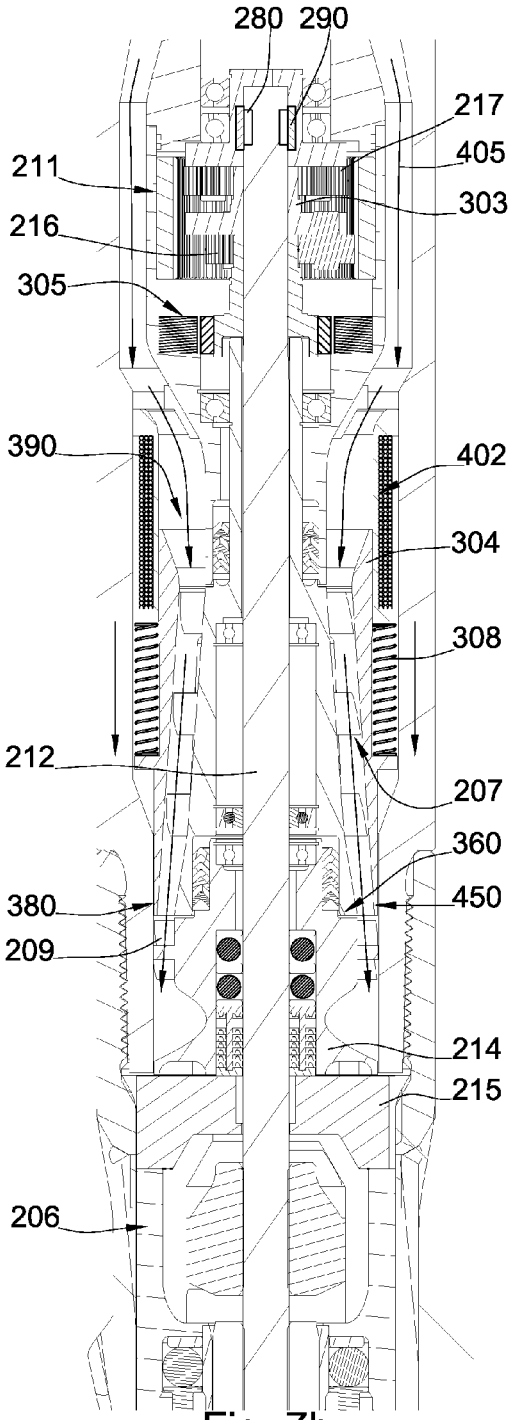
FIG. 7*b* is a cross-sectional diagram of another embodiment of a flow guide, an actuator and a turbine disposed in a drill bit.

Referring now to FIGS. 3 through 4*c*, at least one movable stator 110 may be disposed in the bore 208, which is capable of changing is engagement angle with the fluid in the bore. The at least one movable stator 110 may be connected to a pin arm 111 that is adapted to pivot. An actuator 402 may be disposed in the bore 208 and may be adapted to adjust the position of the at least one movable stator 110. The actuator 402 may be a solenoid, a solenoid valve, an aspirator, a hydraulic piston, a pump, a dc motor, an ac motor, a rack and pinion, a lever, a hammer, a spring or combinations thereof. In the embodiment disclosed in FIGS. 3 through 4*c*, the actuator 402 comprises a solenoid 402 adapted to create a magnetic field within the bore 208, at least one lever 112, and a hammer 114. The at least one lever 112 is connected rigidly to the pin arm 111 opposite the at least one movable stator 110 and is adapted to transfer torque to the pin arm 111. The at least one lever 112 may comprise a catch 133. The hammer 114 may be disposed proximate the at least one solenoid 402 and may comprise at least one flange 144 adapted to fit against the catch 133 of the at least one lever 112. At least one spring 115 may be disposed intermediate the first gear box 211 and the hammer 114 and may be adapted to push the hammer 114 against the at least one lever 112. A preloaded torsion spring 113 may be disposed in the at least one lever 112 and may be adapted to force the catch 133 of the at least one lever 112 against the at least one flange 144. It is believed that adjusting the position of the movable stator 110 may change the angle at which the drilling fluid 405 engages the blades of the turbine 207. It is also believed that adjusting the angle at which the drilling fluid 405 engages the blades of the turbine 207 may adjust the rotational speed of the turbine 207. The at least one stator 110 may be moved by activating the solenoid 402. As the solenoid 402 is activated the solenoid 402 attracts the hammer 114 magnetically pulling the hammer 114 towards the first gear box 211 compressing the at least one spring 115. The preloaded torsion springs 113 continue to force the catch 133 of the at least one lever 112 against the at least one flange 144 of the hammer 114 by turning the at least one lever 112. As the at least one lever 112 turns the at least one lever 112 transfers torque to the pin arm 111 which moves the at least one movable stator 110 in a direction in which the preloaded torsion spring 113 is acting. As the solenoid 402 is deactivated the at least one spring 115 pushes the at least one flange 144 of the hammer 114 against the catch 133 of the at least one lever 112 turning the at least one lever 112 and compressing the preloaded torsion spring 113. As the at least one lever 112 turns and the preloaded torsion spring 113 compressed torque is transferred to the pin arm 111 and the at least one movable stator 110 is moved in a direction opposing the direction in which the preloaded torsion spring 113 is acting. In some embodiment, this mechanism be used to alter the engagement angle of the turbine blades.

The at least one lever 112, the solenoid 402, the hammer 114, the preloaded torsion spring 113, and the at least one spring 115 may be disposed inside a casing 120 of the first gear box 211. The at least one movable stator may be disposed intermediate a wall of the bore 208 and the casing 120 of the first gear box 211 and the pin arm 111 may extend through the casing 120 of the first gear box 211. FIG. 4*a* discloses an embodiment wherein the casing 120 of the first gear box 211 is visible. FIG. 4*b* discloses a view of the same embodiment wherein the casing 120 of the first gear box 211 has been removed. FIG. 4*b* discloses a view of the same embodiment wherein the casing 120 of the first gear box 211 and the solenoid 402 have been removed. The casing 120 of the first gear box 211 may comprise flat surfaces 116 disposed adjacent each of the at least one movable stators 110 adapted to allow the at least one movable stators 110 to maintain full contact with the casing of the first gear box 211 while the at least one movable stators 110 move.

Referring now to FIGS. 5 through 7*b*, sensors 280 may be disposed proximate magnets 290 connected to the drive rod 212 of the first gear box 211 that transfers torque to the jack element 202 and the sensors 280 may be adapted to detect the orientation of the jack element 202 and the rotational speed of the jack element 202. The magnets 290 may also be connected to the jack element 202 and the sensors 280 may be disposed proximate the magnets 290 connected to the jack element 202. The sensors 280 may send data on the orientation and rotational speed of the jack element 202 to the surface via the telemetry system. The turbine 207 may be adapted to actuate an electrical generator 305 disposed in the bore 208. A magnet 307 of the electrical generator 305 may be connected to the drive shaft 303 of the turbine 207 and a conductive coil 306 of the electrical generator 305 may be rotationally fixed. The electrical generator 306 may be disposed in a hydrostatic environment within the bore 208. A polymer coating may be disposed around the conductive coil 306 and may isolate the conductive coil 306 from the hydrostatic environment. The polymer coating may comprise polyimide, Teflon-FEP, Teflon-PTFE, Teflon-PFA, Teflon-AF, or combinations thereof.

A flow guide 304 may be disposed intermediate a plurality of blades 301 of the turbine 207 and a wall of the bore 208 and may be adapted to guide the flow of drilling fluid 405 across the turbine 207. A first end 380 of the flow guide 304 may have a diameter larger than a diameter of a second end 390 of the flow guide 304. The flow guide 304 may comprise a tapered interior surface 370. The actuator 402 may be disposed in the bore 208 and adapted to move the flow guide 304 along a central axis of the drill bit 104 towards and away from a bottom end 360 of the turbine 207. In the embodiment disclosed in FIGS. 4*a* and 4*b*, the actuator 402 comprises a solenoid 402 adapted to create a magnetic field within the bore 208. As the solenoid 402 is activated the magnetic field of the solenoid 402 may attract the flow guide 304 and move the flow guide 304 away from the bottom end 360 of the turbine 360. As the flow guide 304 moves away from the bottom end 360 of the turbine 360 a flow space across the turbine 207 may increase 451 decreasing the velocity of the drilling fluid 405 across the turbine 207 and decreasing the rotational speed of the turbine 207. As the solenoid 402 is deactivated springs 308 in communication with the flow guide 304 may move the flow guide 304 towards the bottom end 360 of the turbine 360. As the flow guide 304 moves towards the bottom end 360 of the turbine 360 the flow guide 304 may restrict 450 the flow space across the turbine 207 increasing the velocity of the drilling fluid 405 across the turbine 207 and increasing the rotational speed of the turbine 207. It is believed that by manipulating the rotational speed of the turbine 207, decreasing the rotational speed of the turbine 207 and increasing the rotational speed of the turbine 207, that the turbine may be able to rotate the flow valve 205 and the jack element 202 at variable speeds. The asymmetrical distal end 203 may also be adjusted to a desired position by adjusting the position of the flow guide 304 so as to increase or decrease a rotational speed of the turbine 207 and the rotational speed of the jack element 202. Adjusting the rotational speed of the flow valve 205 may adjust the rate at which the porting mechanism 206 extends the jack element 202 farther beyond the working surface 201 of the drill bit 104 and back again.

Figure 8A:
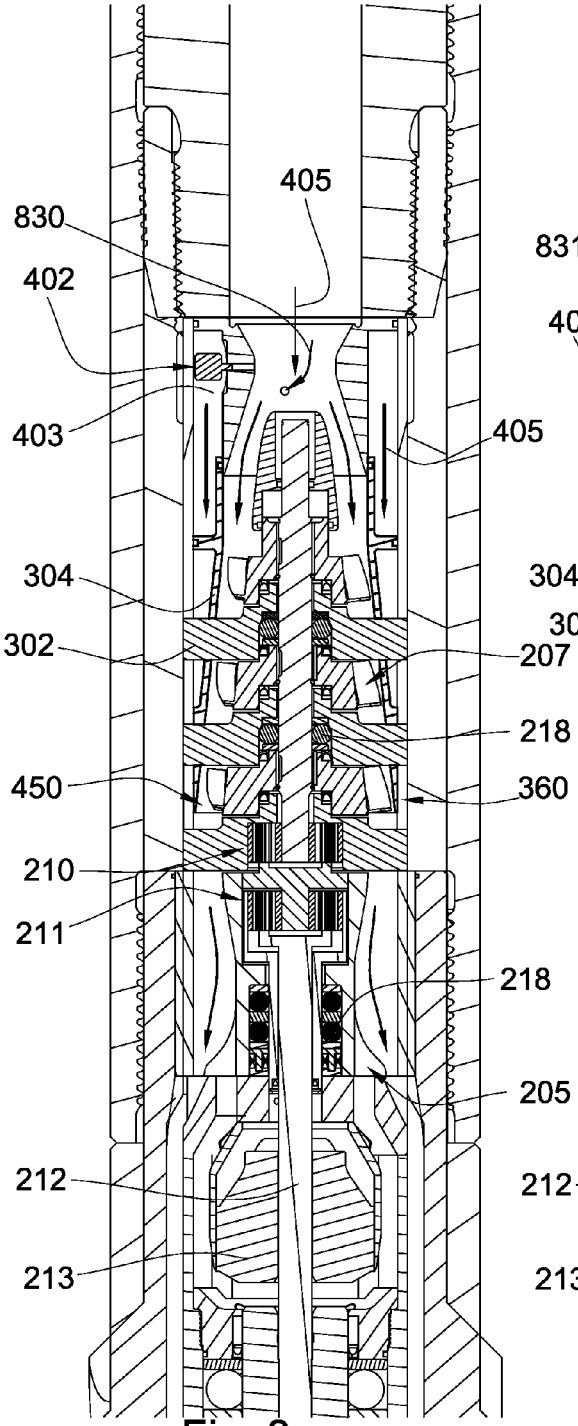
FIG. 8*a* is a cross-sectional diagram of another embodiment of a flow guide, an actuator and a turbine disposed in a drill bit.
Figure 8B:
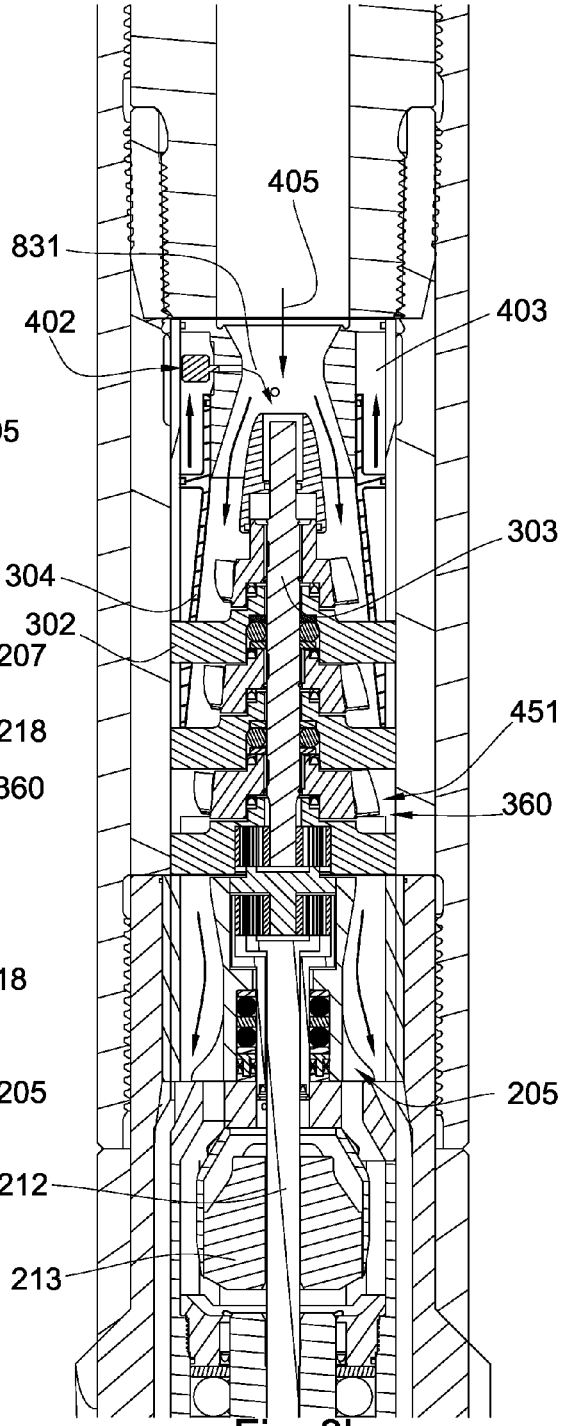
FIG. 8*b* is a cross-sectional diagram of another embodiment of a flow guide, an actuator and a turbine disposed in a drill bit.

Referring now to the embodiment disclosed in FIGS. 8*a* and 8*b*, the actuator 402 may comprise a solenoid valve 402 adapted to direct drilling fluid 405 into and out of a hydraulic piston 403 formed by the flow guide 304 and the wall of the bore 208. The solenoid valve 402 may direct drilling fluid 405 into the hydraulic piston 403 through a high pressure port 830 and the solenoid valve 402 may direct drilling fluid 405 out of the hydraulic piston 403 through a low pressure port 831. As the solenoid valve 402 directs drilling fluid 405 into the hydraulic piston 403 the hydraulic piston 403 moves the flow guide 304 towards the bottom end 360 of the turbine 360. As the flow guide 304 moves towards the bottom end 360 of the turbine 360 the flow guide 304 may restrict 450 the flow space across the turbine 207 increasing the velocity of the drilling fluid 405 across the turbine 207 and increasing the rotational speed of the turbine 207. As the solenoid valve 402 directs drilling fluid out of the hydraulic piston 403 the hydraulic piston 403 moves the flow guide 304 away from the bottom end 360 of the turbine 360. As the flow guide 304 moves away from the bottom end 360 of the turbine 360 the flow space across the turbine 207 may increase 451 decreasing the velocity of the drilling fluid 405 across the turbine 207 and decreasing the rotational speed of the turbine 207.

Figure 9:
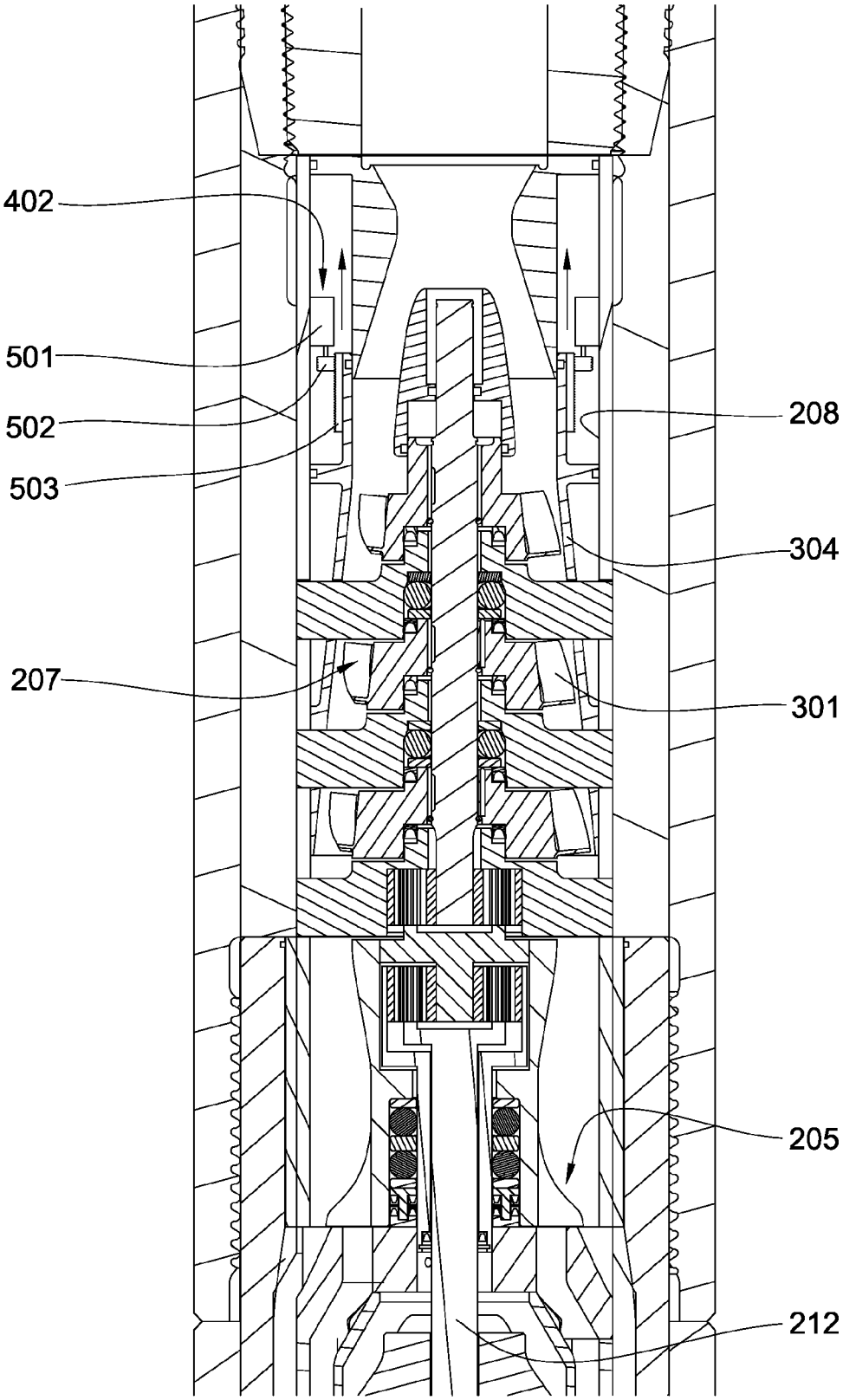
FIG. 9 is a cross-sectional diagram of another embodiment of a flow guide, an actuator and a turbine disposed in a drill bit.

FIG. 9 discloses an embodiment wherein the actuator 402 may comprise at least one dc motor 501 in communication with a rack 503 and pinion 502. The rack 503 may be connected to the flow guide 304 and the pinion 502 may comprise a worm gear 502.

Figure 10:
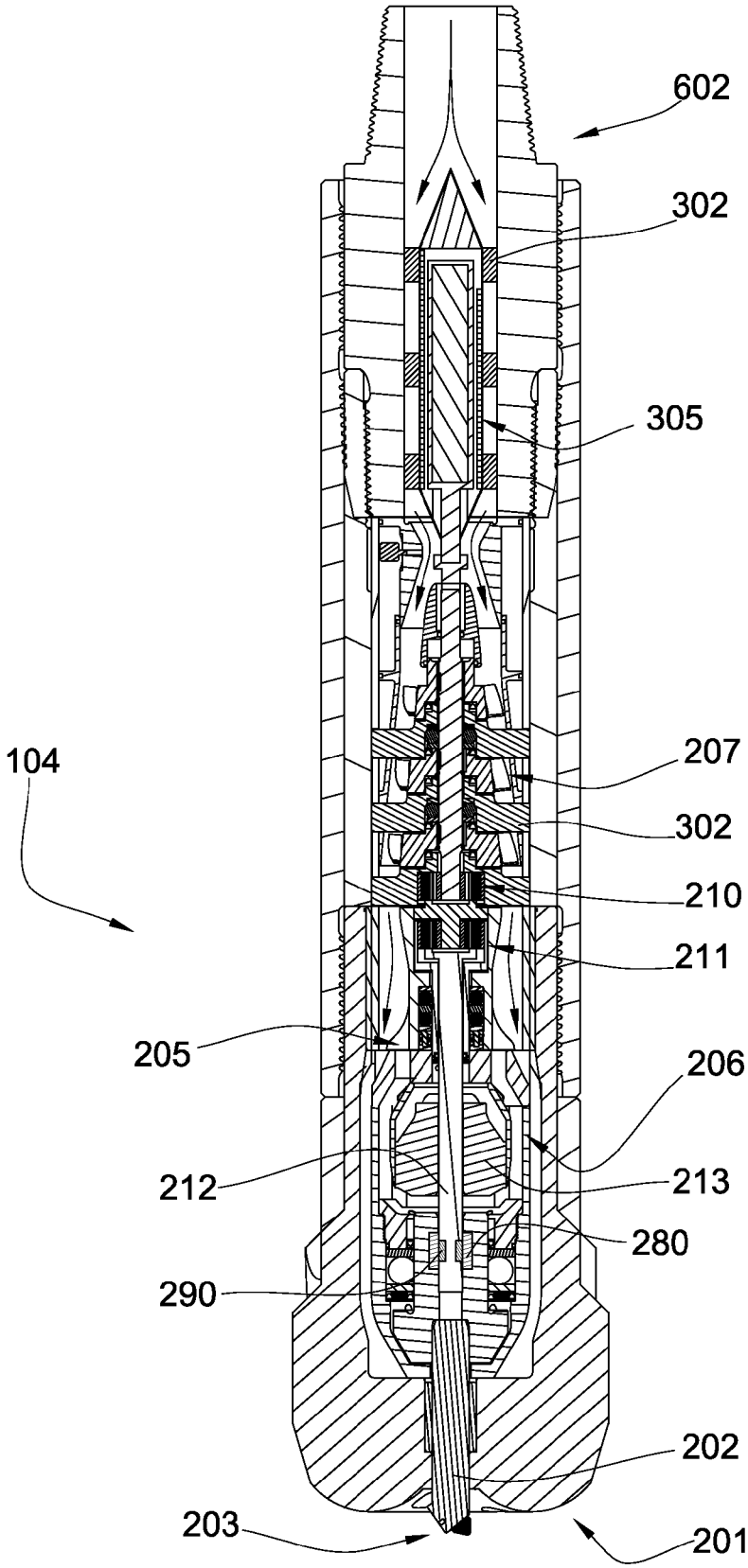
FIG. 10 is a cross-sectional diagram of an embodiment of the drill bit in communication with a component of the drill string.

Referring now to FIG. 10, the turbine 207 may also be adapted to actuate the flow valve 205. A second gear box 210 may be disposed intermediate the turbine 207 and the porting mechanism 206 and may be adapted to transfer torque from the drive shaft 303 of the turbine 207 to the flow valve 205. The second gear box 210 may transfer torque at a different magnitude to the flow valve 205 from the turbine 207 than a magnitude of torque transferred to the jack element 202 from the turbine 207 by the first gear box 211. Sensors 280 may also be disposed proximate magnets connected to a drive rod of the second gear box 210 that transfers torque to the flow valve 205 and may be adapted to detect the orientation of the flow valve 205 and the rotational speed of the flow valve 205. Stators 302 may be disposed in the bore 208 proximate the turbine 207 and may assist in positioning the turbine 207 in the bore 208. The electrical generator 305 may be disposed in a component 602 of the drill string 100 in communication with the drill bit 104. The electrical generator 305 may be disposed in the drill bit 104 and the turbine 207 may be disposed in the component 602 of the drill string 100 in communication with the drill bit 104. The electrical generator 305 may provide electrical power to the actuator 402, to the sensors 280, to the telemetry system, and instruments in communication with the drill string 1 00.

Figure 11:
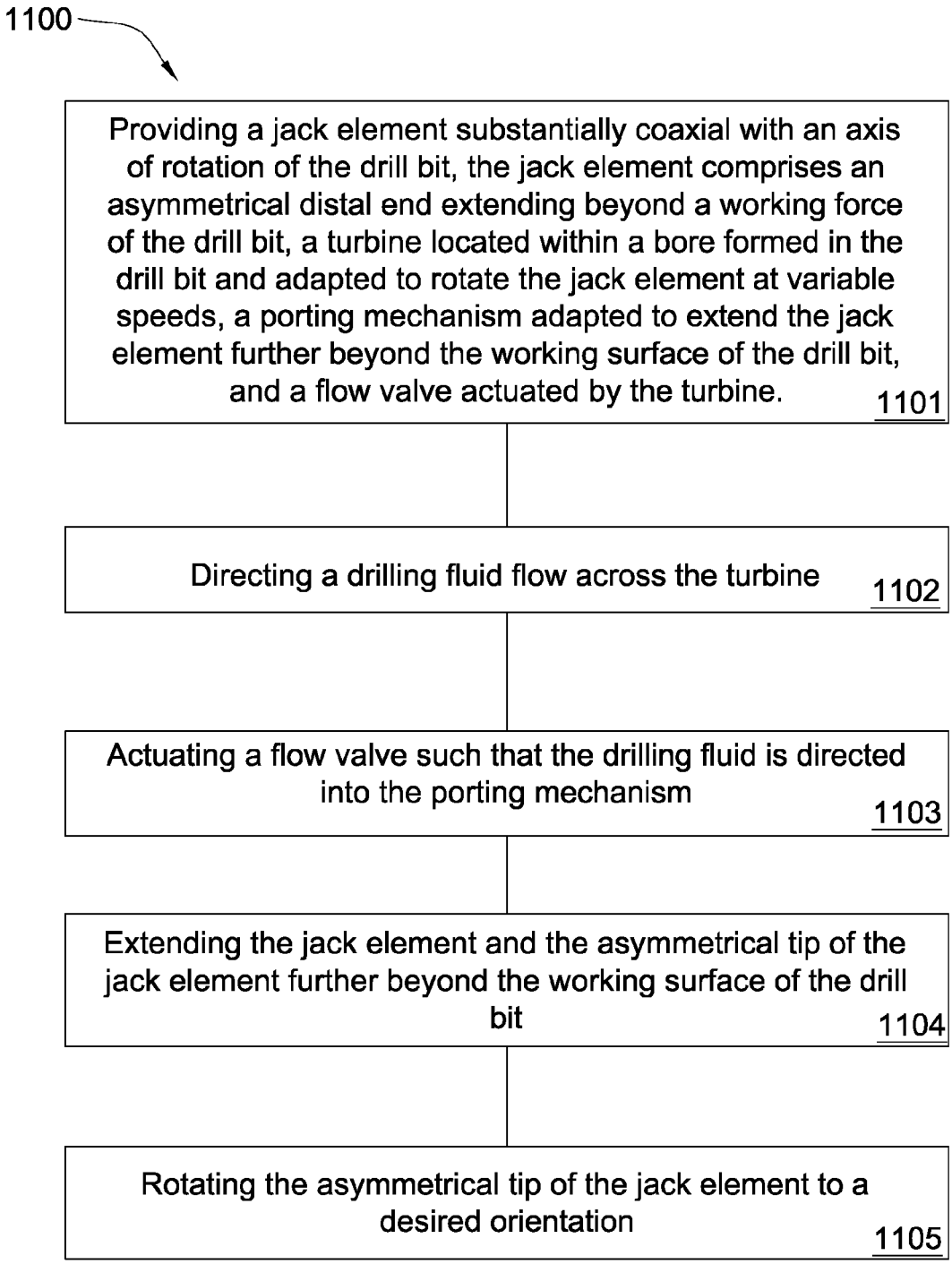
FIG. 11 is a method of an embodiment for steering a drill bit through a formation.

FIG. 11 is a method 1100 of an embodiment for steering a drill bit through a formation and may use the steps of providing 1101 a jack element substantially coaxial with an axis of rotation of the drill bit, the jack element comprises an asymmetrical distal end extending beyond a working face of the drill bit, a turbine located within a bore formed in the drill bit and adapted to rotate the jack element at variable speeds, a porting mechanism adapted to extend the jack element farther beyond the working surface of the drill bit, and a flow valve actuated by the turbine; directing 1102 a drilling fluid flow across the turbine; actuating 1103 a flow valve such that the drilling fluid is directed into the porting mechanism; extending 1104 the jack element and the asymmetrical tip of the jack element farther beyond the working surface of the drill bit; and rotating 1105 the asymmetrical tip of the jack element to a desired orientation.

Figure 12:
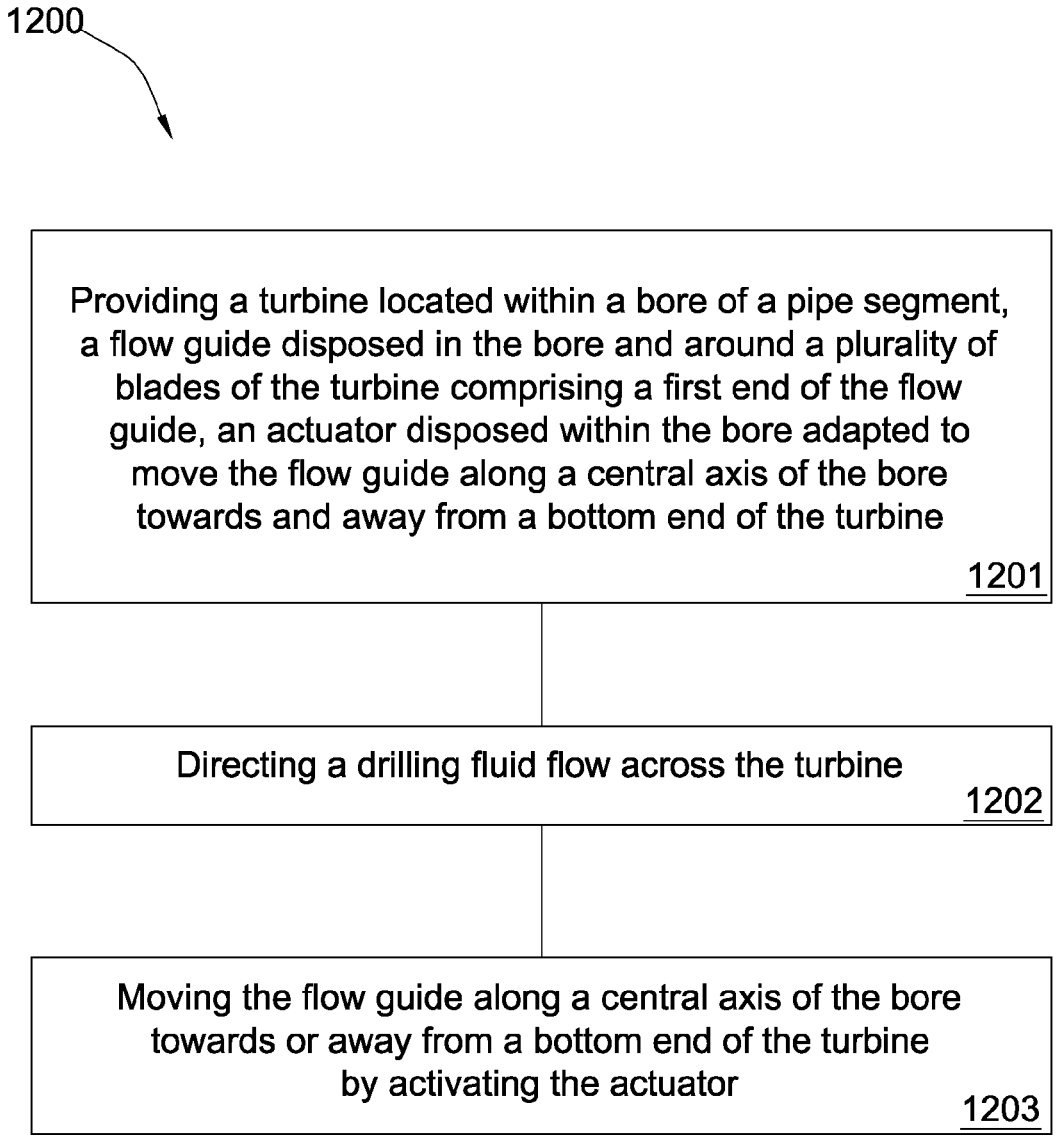
FIG. 12 is a method of an embodiment for adjusting the rotational speed of a turbine.

FIG. 12 is a method 1200 of an embodiment for adjusting the rotational speed of a turbine and may use the steps of providing 1201 a turbine located within a bore of a pipe segment, a flow guide disposed in the bore and around a plurality of blades of the turbine comprising a first end with a diameter larger than a diameter of a second end of the flow guide, an actuator disposed within the bore adapted to move the flow guide along a central axis of the bore towards and away from a bottom end of the turbine; directing 1202 a drilling fluid flow across the turbine; and moving 1203 the flow guide along a central axis of the bore towards or away from a bottom end of the turbine by activating the actuator.

Whereas the present invention has been described in particular relation to the drawings attached hereto, it should be understood that other and farther modifications apart from those shown or suggested herein, may be made within the scope and spirit of the present invention.

What is claimed is:

1. A drill bit, comprising;

a jack element substantially coaxial with an axis of rotation of the drill bit, the jack element comprises an asymmetrical distal end extending beyond a working face of the drill bit;

a turbine located within a bore formed in the drill bit;

a flow valve actuated by the turbine being adapted to route a drilling fluid in the bore into a porting mechanism adapted to extend the jack element farther beyond the working surface of the drill bit; and the turbine being adapted to rotate the jack element at variable speeds.

2. The drill bit of claim 1, wherein a first gear box disposed intermediate the turbine and the jack element is adapted to transfer torque from a drive shaft of the turbine to the jack element.

3. The drill bit of claim 2, wherein a second gear box disposed intermediate the turbine and the porting mechanism is adapted to transfer torque from a drive shaft of the turbine to the flow valve.

4. The drill bit of claim 1, wherein sensors disposed proximate magnets connected to the jack element are adapted to detect the orientation of the jack element and a rotational speed of the jack element.

5. The drill bit of claim 1, wherein a flow guide is disposed intermediate a plurality of blades of the turbine and a wall of the bore and is adapted to guide the flow of drilling fluid across the turbine.

6. The drill bit of claim 5, wherein a first end of the flow guide has a diameter larger than a diameter of a second end of the flow guide.

7. The drill bit of claim 5, wherein the flow guide comprises a tapered interior surface.

8. The drill bit of claim 5, wherein an actuator disposed within the bore is adapted to move the flow guide along a central axis of the drill bit towards and away from a bottom end of the turbine.

9. The drill bit of claim 8, wherein the actuator is a solenoid valve, an aspirator, a hydraulic piston, a pump, a dc motor, an ac motor, a rack and pinion, or combinations thereof.

10. The drill bit of claim 1, wherein the turbine actuates an electrical generator disposed proximate the drill bit.

11. The drill bit of claim 1, wherein the turbine rotates the jack element in a direction opposite to a direction of rotation of the drill bit.

12. The drill bit of claim 1, wherein the porting mechanism is adapted to oscillate the jack element extending the jack element farther beyond the working surface of the drill bit and back again.

13. The drill bit of claim 1, wherein the turbine is disposed in a component of a drill string in communication with the drill bit.

14. The drill bit of claim 1, wherein the porting mechanism comprises a piston adapted to extend the jack element beyond the working surface of the drill bit.

15. The drill bit of claim 1, wherein the flow valve is adapted to route the drilling fluid in the porting mechanism out of the porting mechanism and toward a formation.

16. The drill bit of claim 1, wherein the jack element comprises a bearing, a bushing, or a combination thereof.

17. The drill bit of claim 1, wherein the drill bit is in communication with a telemetry network.

18. A method for steering a drill bit through a formation, comprising the steps of providing a jack element substantially coaxial with an axis of rotation of the drill bit, the jack element comprises an asymmetrical distal end extending beyond a working face of the drill bit, a turbine located within a bore formed in the drill bit and adapted to rotate the jack element at variable speeds, a porting mechanism adapted to extend the jack element farther beyond the working surface of the drill bit, and a flow valve actuated by the turbine;

directing a drilling fluid flow across the turbine;

actuating a flow valve such that the drilling fluid is directed into the porting mechanism;

extending the jack element and the asymmetrical tip of the jack element farther beyond the working surface of the drill bit; and rotating the asymmetrical tip of the jack element to a desired orientation.

* * * * *